US010488054B2

(12) United States Patent
Johnson

(10) Patent No.: US 10,488,054 B2
(45) Date of Patent: Nov. 26, 2019

(54) COOKING APPLIANCE AND COOLING ASSEMBLY THEREFOR

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 216 days.

(21) Appl. No.: 15/444,370

(22) Filed: Feb. 28, 2017

(65) Prior Publication Data

US 2018/0245797 A1 Aug. 30, 2018

(51) Int. Cl.
*F24C 15/00* (2006.01)
*F24C 7/08* (2006.01)
*F24C 15/04* (2006.01)

(52) U.S. Cl.
CPC ..... *F24C 15/006* (2013.01); *F24C 7/085* (2013.01); *F24C 15/04* (2013.01)

(58) Field of Classification Search
CPC ..... F24C 15/006; F24C 7/085; F24C 15/04
USPC ..... 126/21 A; 219/757
See application file for complete search history.

(56) References Cited

U.S. PATENT DOCUMENTS 3,889,100 A * 6/1975 Dills ..... F24C 15/006 126/198
6,067,980 A 5/2000 Kahlke et al.
6,234,161 B1 * 5/2001 Levi ..... F24C 15/006 126/19 R
7,431,029 B2 10/2008 Kim et al.
7,686,009 B2 * 3/2010 Park ..... F24C 15/006 126/190
7,856,972 B2 * 12/2010 Lee ..... F24C 3/067 126/214 R
8,334,482 B2 * 12/2012 Nam ..... F24C 15/006 219/392
8,875,695 B2 11/2014 Yi
2008/0184985 A1 * 8/2008 Hasslberger ..... F24C 15/006 126/21 R
2009/0183724 A1 * 7/2009 Hirano ..... F24C 15/322 126/21 A
2009/0194090 A1 * 8/2009 Kim ..... F24C 15/006 126/198
2010/0276413 A1 * 11/2010 Nam ..... F24C 15/006 219/392
2015/0323195 A1 * 11/2015 Chadwick ..... F24C 15/006 126/21 A (Continued)

FOREIGN PATENT DOCUMENTS

DE 19504673 A1 * 8/1996 ..... F24C 15/006
DE 10211379 A1 * 9/2003 ..... F24C 7/08
EP 520635 A1 12/1992

*Primary Examiner* — Avinash A Savani
*Assistant Examiner* — Aaron H Heyamoto
(74) *Attorney, Agent, or Firm* — Dority & Manning, P.A.

(57) ABSTRACT

A cooking appliance and cooling assembly therefor is provided herein. The cooking appliance may include a cabinet defining a cooling passage. The cooling passage may extend, for instance, along the top portion of the cabinet. A control panel may be provided in fluid communication with the cooling passage. Additionally or alternatively, an exhaust panel may be provided to define an output vent proximate to one of the opposing sidewalls in fluid communication with the cooling passage.

19 Claims, 11 Drawing Sheets

(56) References Cited

U.S. PATENT DOCUMENTS

2015/0369491 A1* 12/2015 Estrella ..... F24C 15/006
126/21 A
2017/0292713 A1* 10/2017 Boedicker ..... F24C 15/006

* cited by examiner

COOKING APPLIANCE AND COOLING ASSEMBLY THEREFOR

FIELD OF THE INVENTION

The present subject matter relates generally to a cooking appliance, and more particularly to a cooking appliance having one or more assemblies for improved cooling of the cooking appliance.

BACKGROUND OF THE INVENTION

Cooking appliances generally define one or more enclosures supporting one or more heating elements. For instance, oven appliances can include a cabinet defining an insulated cooking chamber therein for receipt of food items for cooking. A cooktop having heating elements may be positioned at a top portion of the cabinet for, e.g., grilling, boiling or frying food items thereon. Other heating elements, such as a bake heating element and/or broil heating element may be positioned within the cooking chamber to provide heat to food items located therein. The bake heating element is positioned at a bottom of the cooking chamber. The broil heating element positioned at a top of the cooking chamber. One or more electronic components may be housed within cabinet outside of cooking chamber. During operation of the various heating elements, portions of the cabinet, such as the areas adjacent to cooking chamber and/or cooktop, may be indirectly heated.

Portions of the cabinet, such as those housing electronic components, are preferably maintained below one or more threshold temperatures during operation of the oven range appliance. Certain oven range appliances include a duct system that draws or pulls air into the cabinet for cooling an outer surface of the cabinet during operation. Specifically, certain oven range appliances define a cooling channel between, e.g., the cooking chamber and a top panel of the cabinet. Air may flow into the cooling chamber and about the cooking chamber to maintain a surface of, e.g., the top panel of the cabinet below a desired temperature threshold.

In at least some of these oven range appliances, airflow through the cooling channel tends to rise vertically to a top end of the oven range appliance. In turn, heated air about certain portions of the oven range appliance may stagnate. For instance, heated air passing across or through a door of the oven range appliance may stagnate between the door, the cabinet, and a control panel. As another example, heated air between the cooktop and an upper wall of the cooking chamber may stagnate, especially at lateral extremes of the oven range appliance. If the heated air stagnates for too long or reaches too high of a temperature, undesirable conditions may arise. In some cases, damage may be caused to one or more portion of the appliance.

Therefore, a cooking appliance providing for more uniform cooling may be desirable. In particular, a cooking appliance providing one or more features for cooling air proximate the control panel and/or a top portion of the appliance would be beneficial. More particularly, a device for providing more uniform cooling of the surface of the side panel by more evenly distributing a cooling airflow through the cooling channel would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a cooking appliance is provided. The cooking appliance may include a cabinet, a control panel, and a face panel. The cabinet may extend in a vertical direction between a top portion and a bottom portion and in a lateral direction between opposing sidewalls. The cabinet may define a cooling passage extending along the top portion. The control panel may be mounted to the cabinet in fluid communication with the cooling passage. The control panel may also define a portion of an electronics chamber. The face panel may extend below the top portion of the cabinet relative to the vertical direction at a front portion of the cabinet. The face panel may also define a ventilation inlet in fluid communication with the cooling passage to direct air through the electronics chamber.

In another aspect of the present disclosure, a cooking appliance is provided. The cooking appliance may include a cabinet, a top panel, a heating element, an internal wall, and an exhaust panel. The cabinet may extend in a transverse direction between a rear portion and a front portion and in a lateral direction between opposing sidewalls. The top panel may extend along a top portion of the cabinet. The heating element may be attached to the top panel. The internal wall may extend below the top panel such that a cooling passage is defined between the top panel and the internal wall. The exhaust panel may be positioned at the rear portion of the cabinet. The exhaust panel may define an output vent proximate to one of the opposing sidewalls in fluid communication with the cooling passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
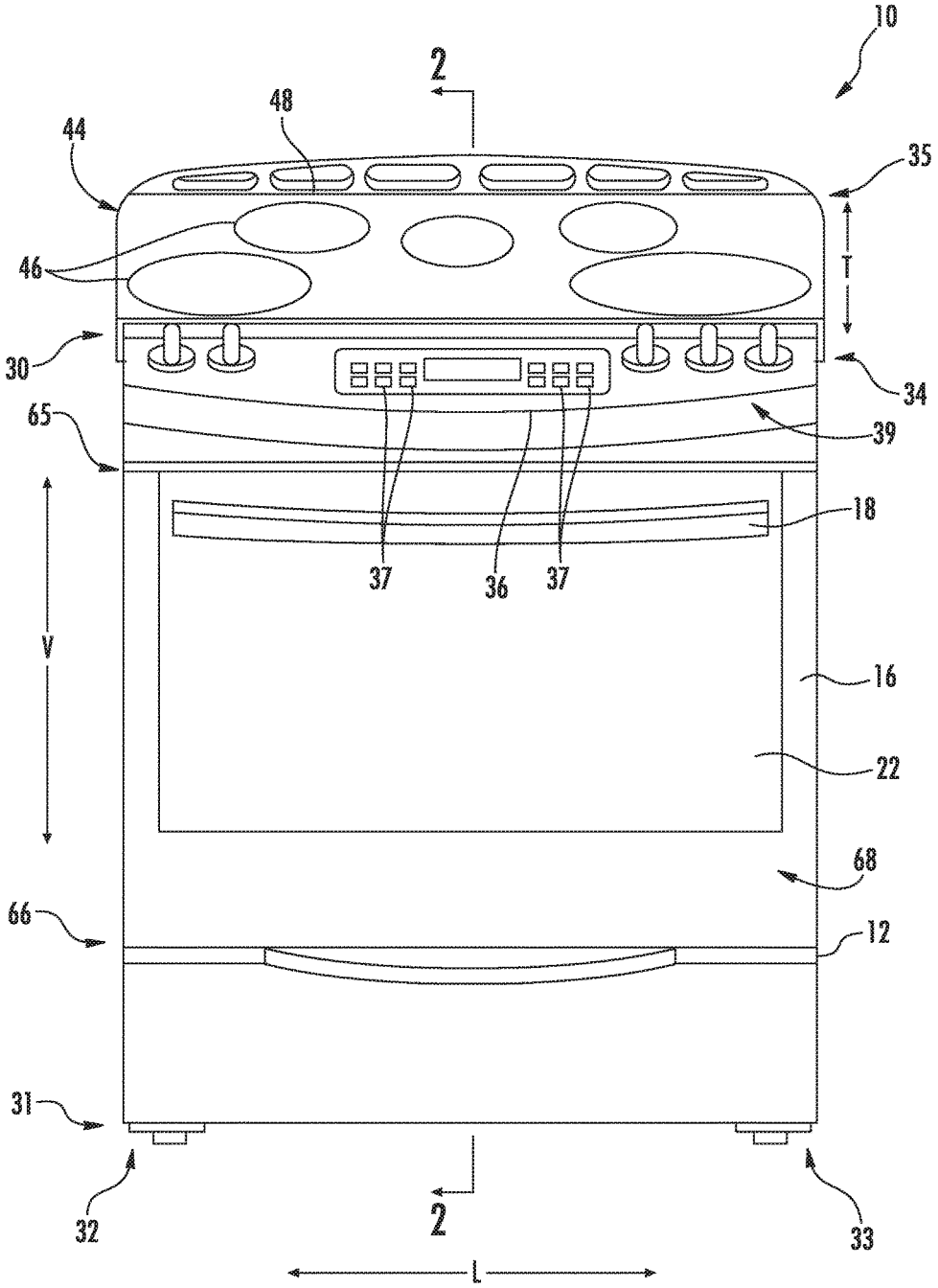
FIG. 1 provides a front perspective view of a cooking appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
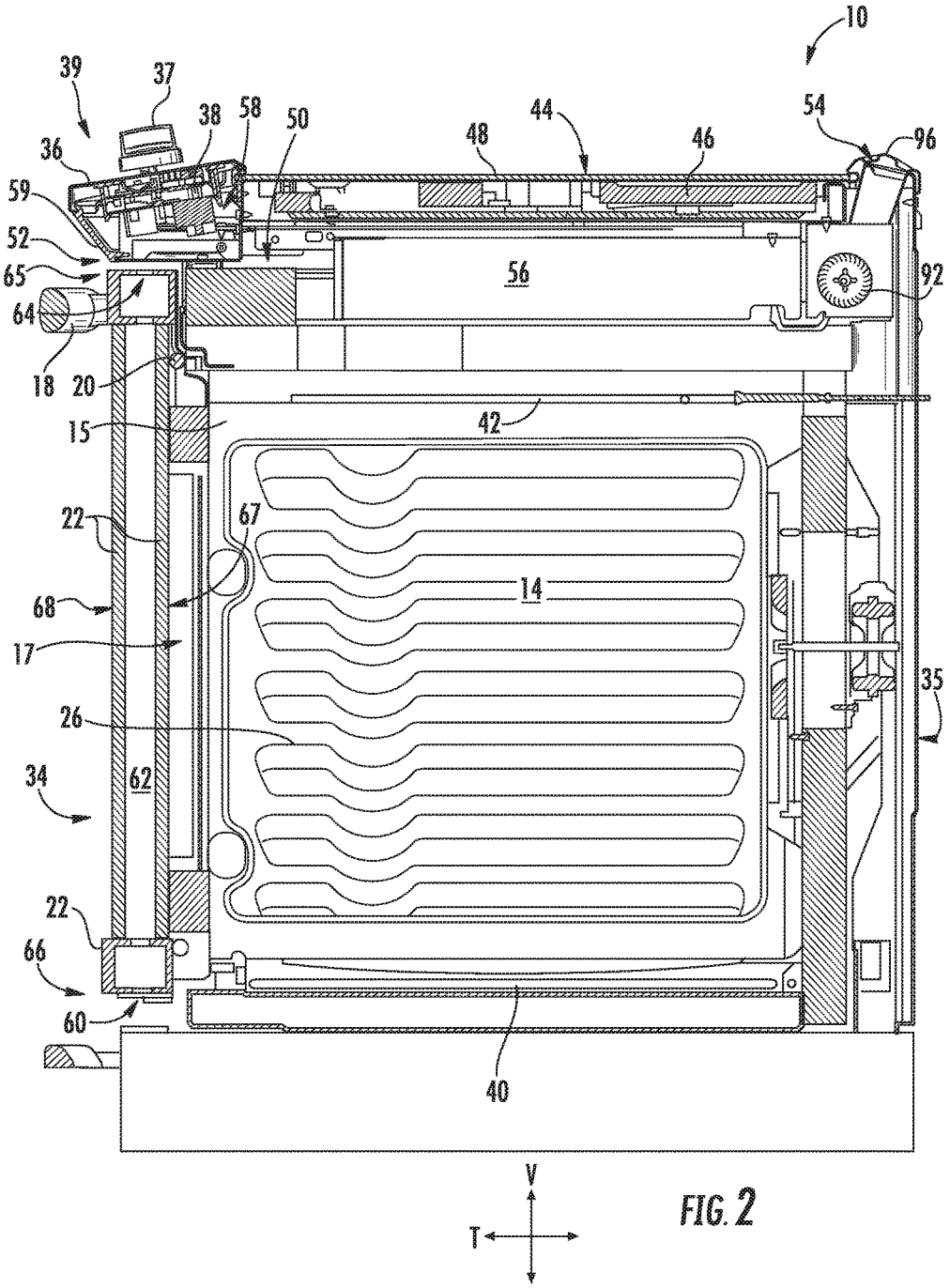
FIG. 2 provides a cross sectional view of the example cooking appliance of FIG. 1, taken along the line 2-2.

Turning now to the figures, FIG. 1 provides a front perspective view of an oven range appliance 10 according to an example embodiment of the present disclosure. FIG. 2 provides a side, cross section view of oven range appliance 10 taken along the 2-2 line of FIG. 1 (e.g., taken in a plane that is perpendicular to a lateral direction L). It should be understood that oven range appliance 10 is provided by way of example only and is not intended to limit the present disclosure in any aspect. Thus, the present disclosure may be used with other oven range appliance configurations, e.g., that define multiple interior cavities for the receipt of food and/or having different pan or rack arrangements than what is shown in FIG. 2. Further, the present disclosure may be used in any other suitable cooking appliance, e.g., a wall oven appliance, counter-mounted range appliance, etc.

As may be seen in FIGS. 1 and 2, oven range appliance 10 defines a vertical direction V, a lateral direction L, and a transverse direction T. The vertical direction V, lateral direction L, and transverse direction T are each mutually perpendicular and together form an orthogonal direction system. Oven range appliance 10 includes an insulated cabinet 12. Cabinet 12 extends between a top portion 30 and a bottom portion 31, e.g., along the vertical direction V. Cabinet 12 also extends between a first sidewall 32 and a second sidewall 33, e.g., along the lateral direction L. Cabinet 12 further extends between a front portion 34 and a back portion 35, e.g., along the transverse direction T. An internal wall 15 is generally positioned within cabinet 12 and defines an insulated cooking chamber 14.

As may be seen in FIG. 2, a door 16 is mounted on the cabinet 12. For instance, door 16 may be pivotally mounted below a cooling passage 56 to selectively restrict access to the cooking chamber 14 (e.g., when in a closed setting, as shown in FIG. 2). A handle 18 is mounted to door 16 and generally assists a user with opening and closing door 16 for access cooking chamber 14.

Some embodiments of oven range appliance 10 also include a seal or gasket 20 that extends between door 16 and cabinet 12, e.g., when door 16 is in the closed position. Gasket 20 may assist with maintaining heat and cooking fumes within cooking chamber 14 when door 16 is in the closed position, as shown in FIG. 2. Multiple (e.g., two) parallel glass panes 22 provide for viewing the contents of cooking chamber 14 when door 16 is in the closed position and may also assist with insulating cooking chamber 14. A baking rack (not shown) may be positioned in cooking chamber 14 for the receipt of food items or utensils containing food items. The baking rack may be slidably received onto embossed ribs or sliding rails 26 defined on internal wall 15 such that the baking rack may be conveniently moved into and out of cooking chamber 14 when door 16 is open.

A bake or bottom heating element 40 is positioned in cabinet 12, e.g., at or adjacent bottom portion 31 of cabinet 12. Bottom heating element 40 is used to heat cooking chamber 14 for both cooking and cleaning of oven range appliance 10. The size and heat output of bottom heating element 40 can be selected based on, for example, the size of oven range appliance 10. Bottom heating element 40 can be any suitable heating element. For example, bottom heating element 40 may be an electric resistance heating element, a gas burner, a microwave heating element, etc.

A broil or top heating element 42 is also positioned in cooking chamber 14 of cabinet 12, e.g., at or adjacent top portion 30 of cabinet 12. Top heating element 42 is used to heat cooking chamber 14 for both cooking/broiling and cleaning of oven range appliance 10. Like bottom heating element 40, the size and heat output of top heating element 42 can be selected based on, for example, the size of oven range appliance 10. Top heating element 42 can be any suitable heating element. For example, top heating element 42 may be an electric resistance heating element, a gas burner, a microwave heating element, etc.

Oven range appliance 10 also includes a cooktop 44 positioned at top portion 30 of oven range appliance 10. As shown, cooktop 44 includes a top panel 48 that is mounted to cabinet 12 (e.g., at the top portion 30). Top panel 48 may be a generally planar member having an upper surface that is perpendicular to the vertical direction V. Top panel 48 may be formed from glass, glass ceramic, metal, or another suitable material. Cooktop 44 further includes a plurality of heating assemblies 46 positioned mounted to top panel 48. In some embodiments, heating assemblies 46 are positioned above cooking chamber 14 of cabinet 12 (i.e., higher relative to the vertical direction V). Optionally, heating assemblies 46 may extend between cooking chamber 14 and top panel 48, within or outside of the cooling passage 56. Cooking utensils, such as pots, pans, griddles, etc., may be placed on top panel 48 and heated with heating assemblies 46 during operation of oven range appliance 10. In FIGS. 1 and 2, heating assemblies 46 are shown as radiant heating elements mounted below top panel 48. However, in alternative example embodiments, heating assemblies 46 may be any suitable heating assembly, such as gas burner elements, resistive heating elements, induction heating elements, etc.

As shown, oven range appliance 10 further includes a cooling assembly 50 defining cooling passage 56. Cooling assembly 50 is positioned adjacent top portion 30 of cabinet 12, e.g., such that cooling passage 56 extends between heating assemblies 46 and cooking chamber 14 along the vertical direction V. Specifically, cooling passage 56 may be defined between top panel 48 and internal wall 15. Cooling assembly 50 may be generally configured to direct air through (e.g., into and out of) a portion of cabinet 12. In example embodiments, cooling assembly 50 may be in fluid isolation from cooking chamber 14 (e.g., such that air is not exchanged directly therebetween). In alternative embodiments, an exchange passage (not pictured) may be defined in fluid communication between the cooking chamber 14 and cooling passage 56, e.g., through internal wall 15. During operations, air may thus pass directly from the cooking chamber 14 and to the cooling passage 56.

Cooling assembly 50 may be generally shaped to limit or reduce heat transfer along the vertical direction V during operation of oven range appliance 10. In particular, cooling assembly 50 is configured for directing a flow of air F (see FIG. 3) therethrough in order to advantageously limit or reduce heat transfer along the vertical direction V during operation of one or more of the heating elements at 40, 42, 46 of oven range appliance 10. Cooling assembly 50 is discussed in greater detail below.

As shown, oven range appliance 10 is further equipped with a controller 38 to regulate operation of the oven range appliance 10. For example, controller 38 may regulate the operation of oven range appliance 10 including heating elements 40, 42, and/or 46. Controller 38 may be in communication (via for example a suitable wired or wireless connection) with the heating elements 40, 42, and/or 46 and other suitable components of the oven range appliance 10, as discussed herein. In general, controller 38 may be operable to configure the oven range appliance 10 (and various components thereof) for cooking. Such configuration may be based on a plurality of cooking factors of a selected operating cycles, sensor feedback, etc.

By way of example, controller 38 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 38 may be positioned in a variety of locations throughout oven range appliance 10. In the illustrated embodiment, controller 38 is mounted to control panel 36. Specifically, controller 38 is located beneath a user interface 39 of oven range appliance 10, as shown in FIG. 2. In such an embodiment, input/output ("I/O") signals may be routed between the controller 38 and various operational components of oven range appliance 10, e.g., along wiring harnesses that may be routed through cabinet 12. Typically, controller 38 is in communication with user interface 39 and inputs 37 through which a user may select various operational features and modes, and may monitor progress of oven range appliance 10. In some embodiments, user interface 39 represents a general purpose I/O ("GPIO") device or functional block. In additional or alternative embodiments, user interface 39 includes input components or inputs 37, such as one or more of a variety of electrical, mechanical or electro-mechanical input devices including rotary dials, push buttons, and touch pads. User interface further 39 may include a display component, such as a digital or analog display device designed to provide operational feedback to a user.

When assembled, user interface 39 may be in communication with controller 38 via one or more signal lines or shared communication busses. Controller 38 may also be communication with one or more sensors, e.g., a temperature sensor that is used to measure temperature inside insulated cooking chamber 14 and provide such measurements to controller 38. For example, a temperature sensor may be a thermocouple, a thermistor, a resistance temperature detector, or any other device suitable for measuring a temperature on appliance 10 (e.g., within cooking chamber 14 and/or at top panel 48). In this manner, controller 38 may selectively control heating elements 40, 42, and/or 46 in response to user manipulation of user interface 39 and temperature feedback from a temperature sensor. Controller 38 can also receive temperature measurements from a temperature sensor placed within insulated cooking chamber 14 and, for example, provide a temperature indication to the user with display device.

As shown, cooling assembly 50 defines at least one inlet 52 and at least one outlet 54. Inlet 52 is positioned at or adjacent front portion 34 of cabinet 12. Inlet 52 of cooling assembly 50 is also positioned adjacent or proximate to door 16, e.g., when door 16 is in the closed position. Conversely, outlet 54 of cooling assembly 50 is positioned at or adjacent to back portion 35 of cabinet 12. In some embodiments, outlet 54 of cooling assembly 50 is positioned within a vent trim 96 of oven range appliance 10 at back portion 35 of cabinet 12, as will be described in detail below.

Control panel 36 includes user interface 39 and generally defines a portion of electronics chamber 58. When assembled, electronics chamber 58 is configured to receive a variety of electronic components of oven range appliance 10. For example, electronics chamber 58 may receive and/or support a portion of user interface 39, controller 38, various regulating valves, and/or other electronic components. In some embodiments, control panel 36 is positioned at front portion 35 of cabinet 12 along the transverse direction T and adjacent top panel 48 along the vertical direction V. In turn, electronics chamber 58 may be defined at a forward position from the cooling passage 56. In alternative embodiments, control panel 36 may be positioned at back portion 35 of cabinet 12. Moreover, control panel 36 may be positioned above panel 48 and mounted to cabinet 12 on, for example, a backsplash (not pictured).

As will be described in further detail below, a face panel 59 extends below top panel 48 (e.g., along the vertical direction V) and defines one or more inlets to cooling passage 56. In certain embodiments, such as those shown in FIGS. 1 and 2, control panel 36 further defines or encloses the electronics chamber 58 with face panel 59. In other embodiments, face panel 59 is positioned forward from control panel 36 and upstream from cooling passage 56, which may also be defined upstream m from electronics chamber 58.

Figure 3:
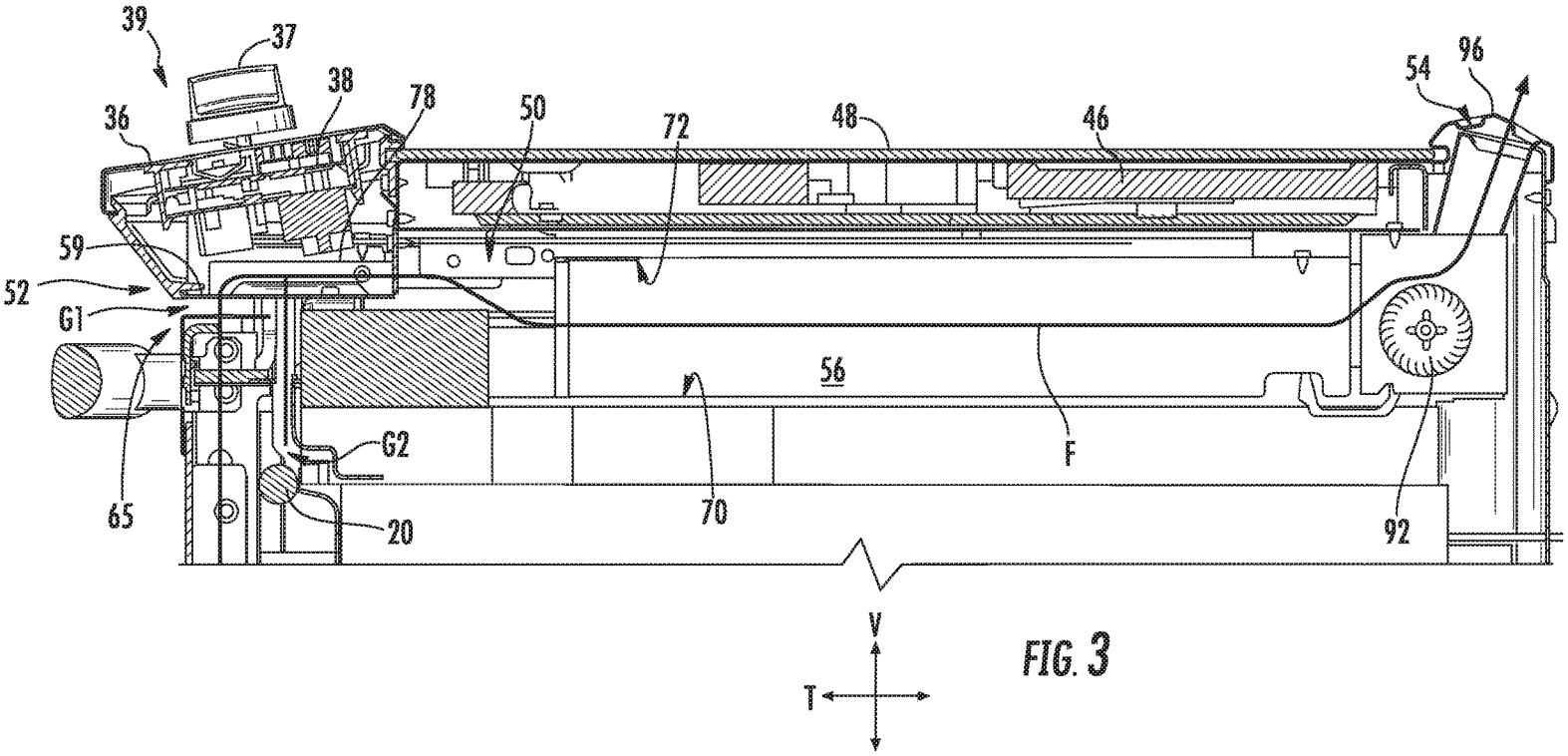
FIG. 3 provides a magnified cross sectional view of a top portion of the example cooking appliance of FIG. 1.
Figure 4:
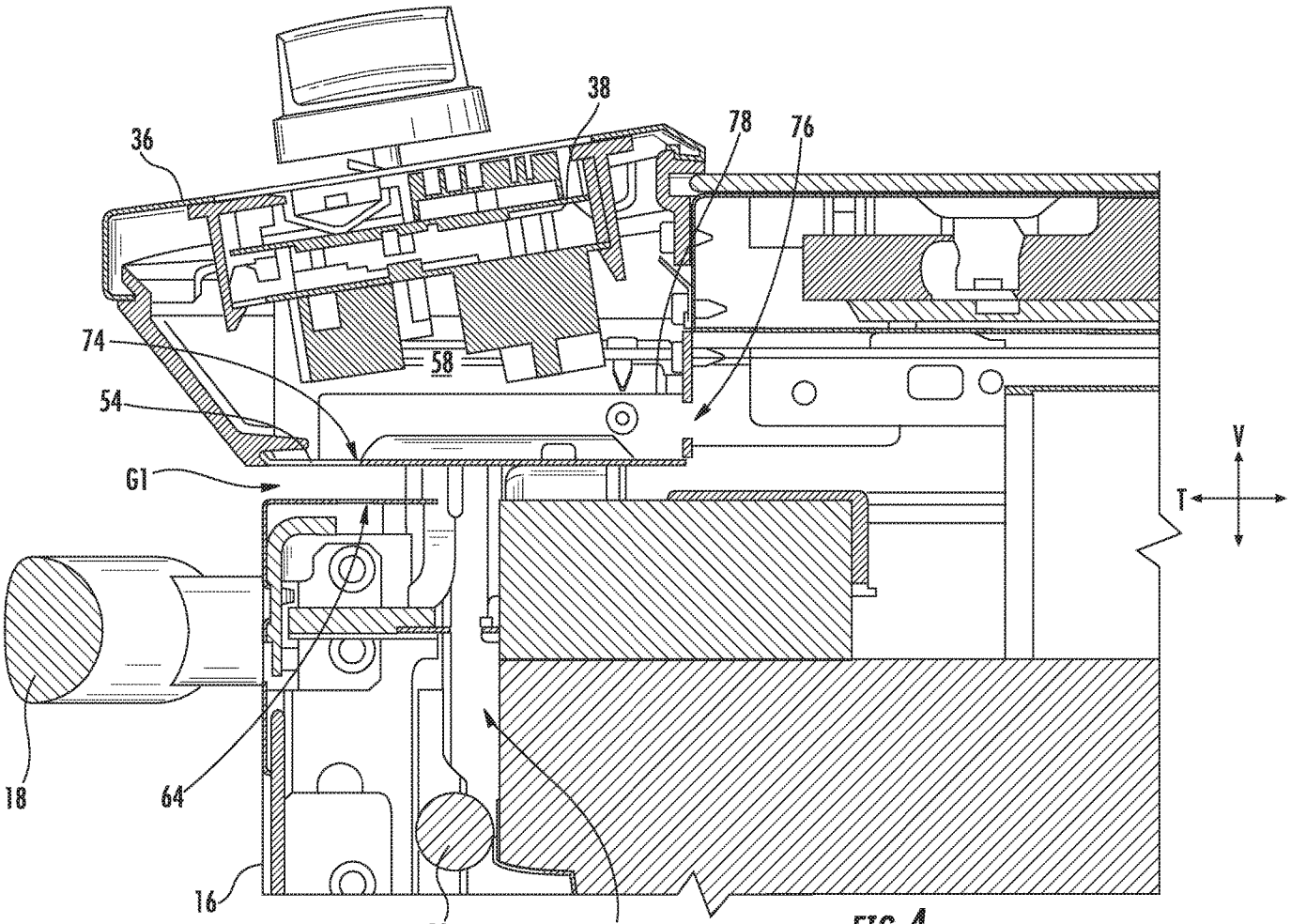
FIG. 4 provides a magnified cross sectional view of a front portion of the example cooking appliance of FIG. 1.
Figure 5:
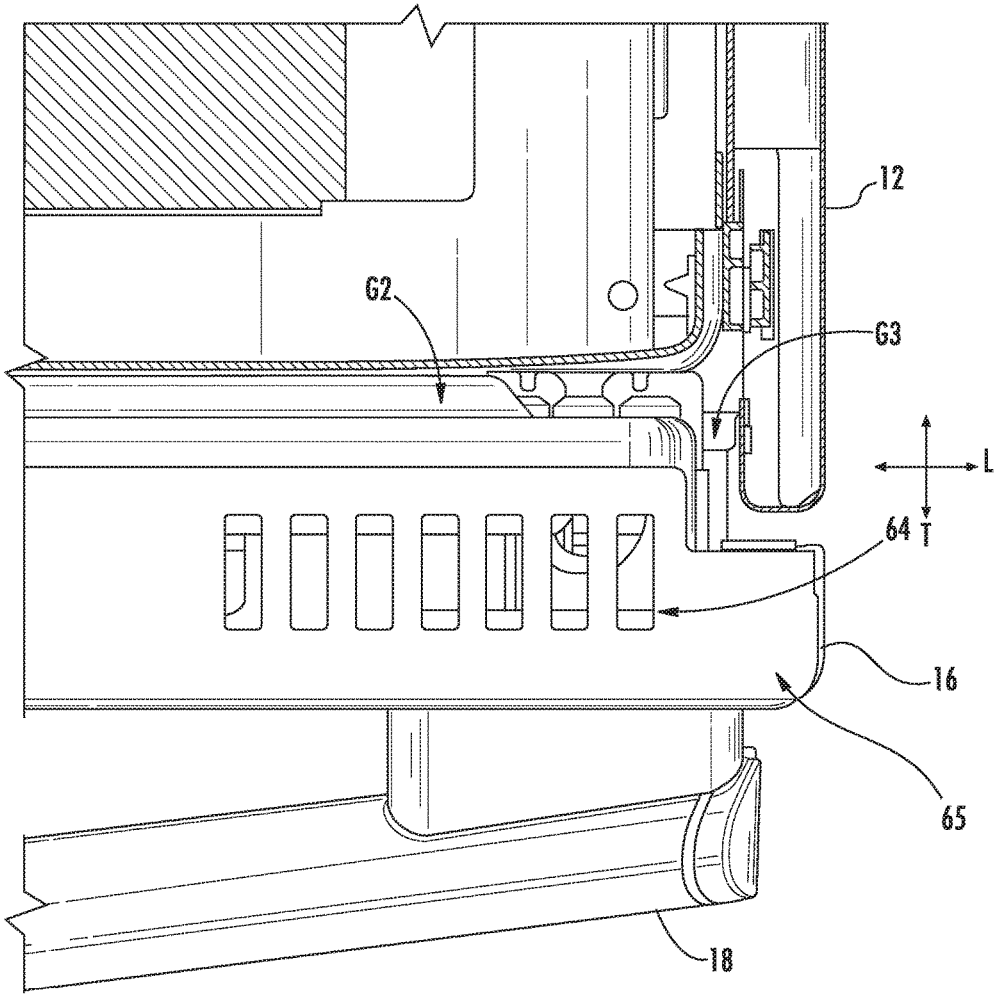
FIG. 5 provides a magnified top view of a portion of the example cooking appliance, including a door thereof, of FIG. 1.
Figure 6:
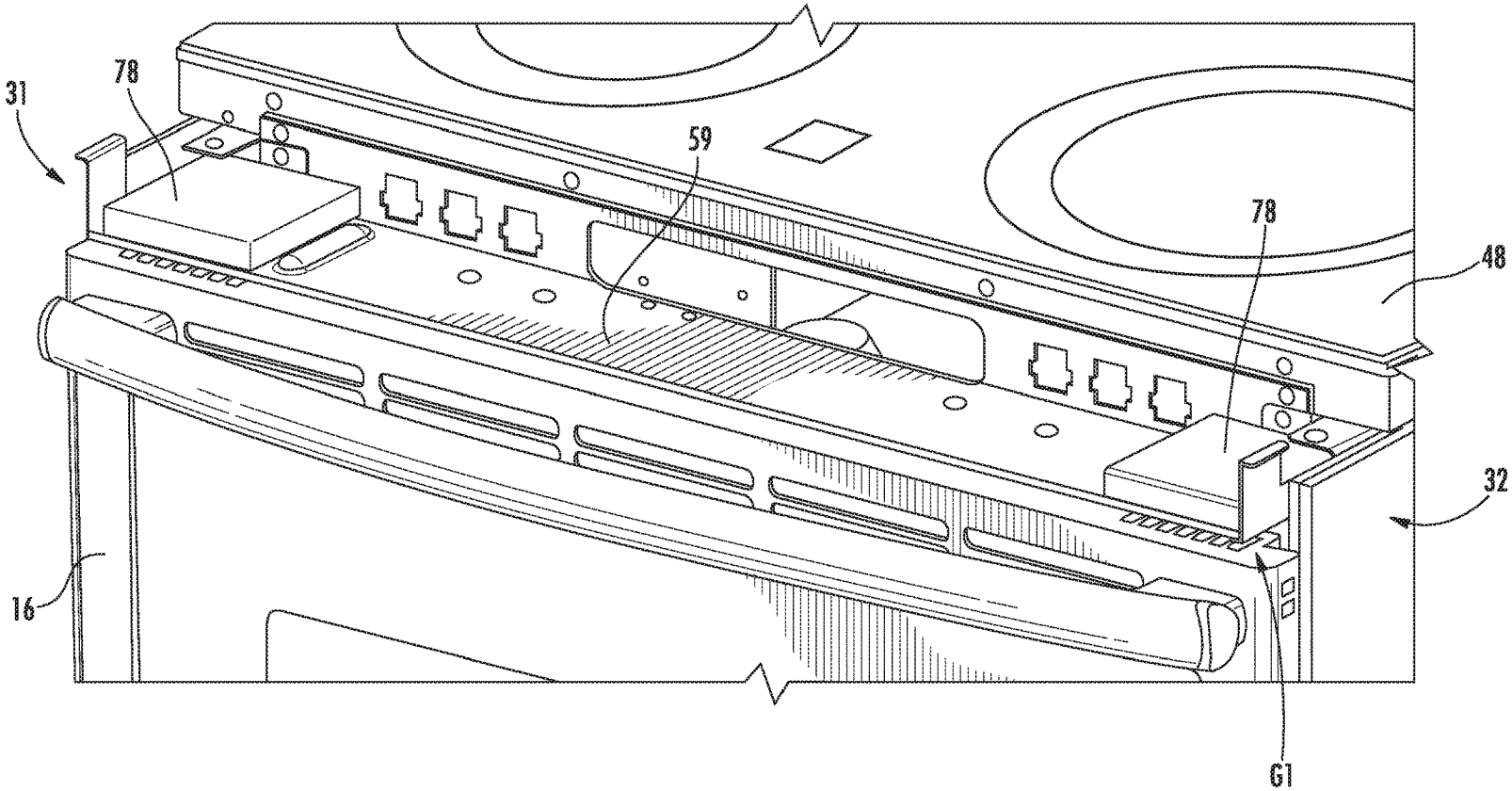
FIG. 6 provides a front perspective view of the front portion of the example cooking appliance of FIG. 1, wherein a control panel has been removed.
Figure 7:
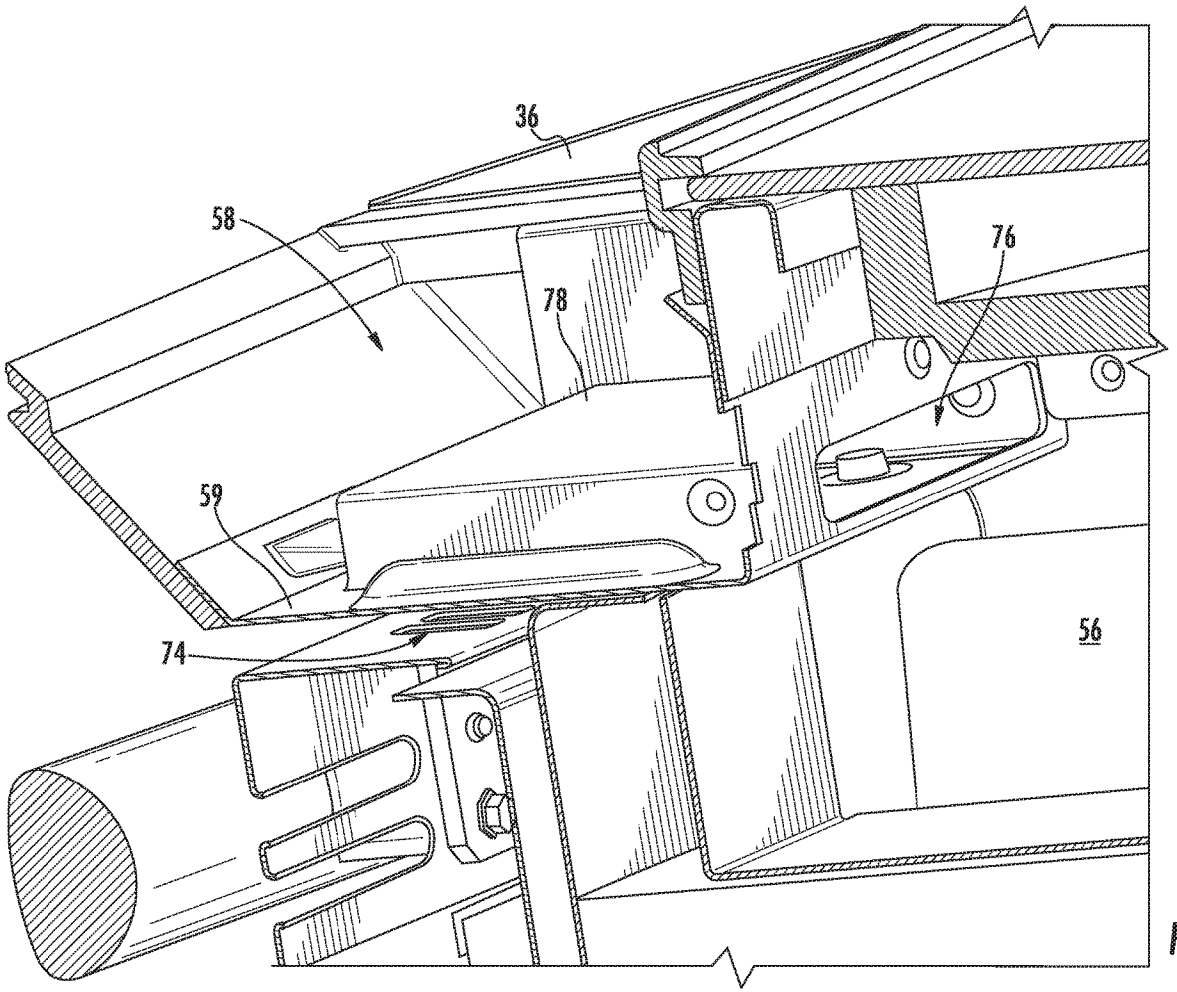
FIG. 7 provides a rear perspective cross sectional view of the front portion of the example cooking appliance of FIG. 1.
Figure 8:
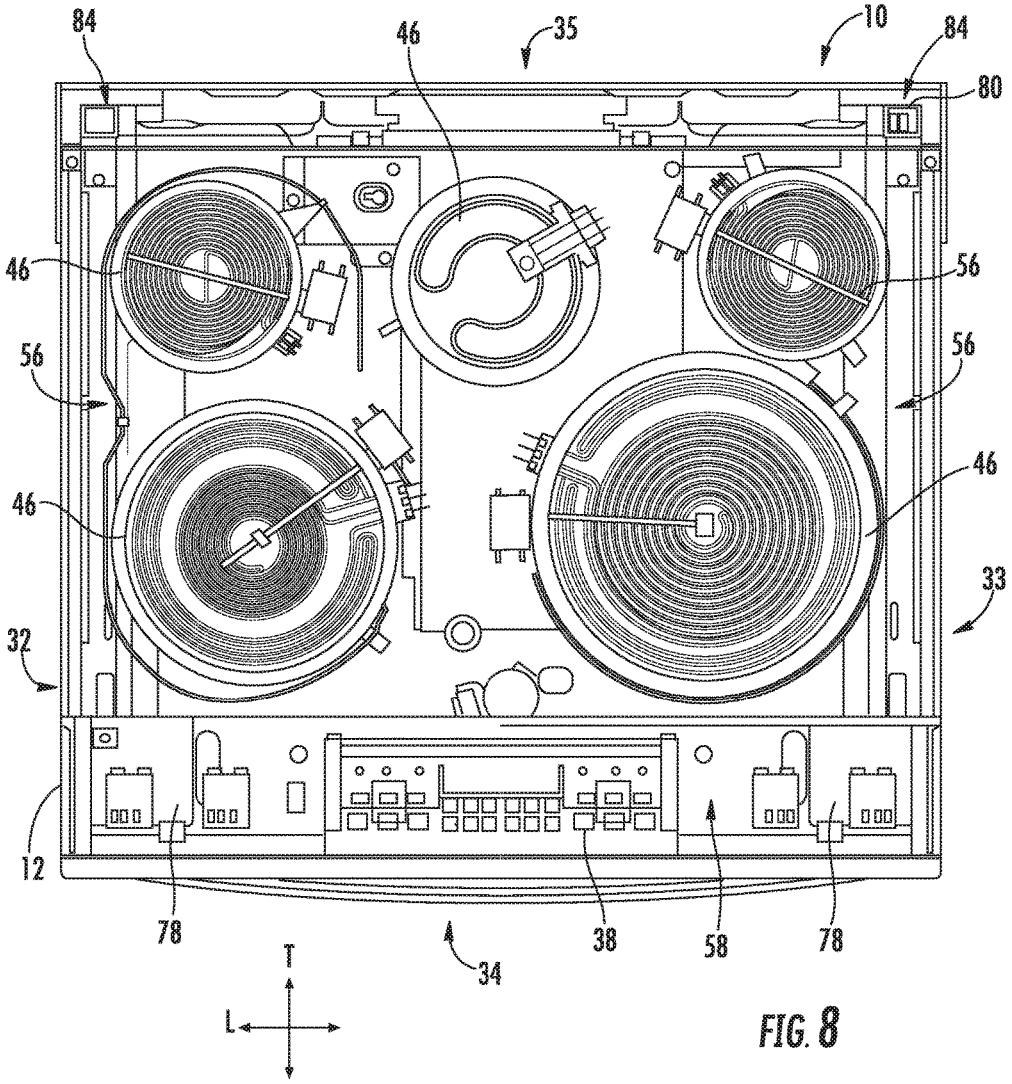
FIG. 8 provides a transparent top view of a cooking appliance according to example embodiments of the present disclosure.
Figure 9:
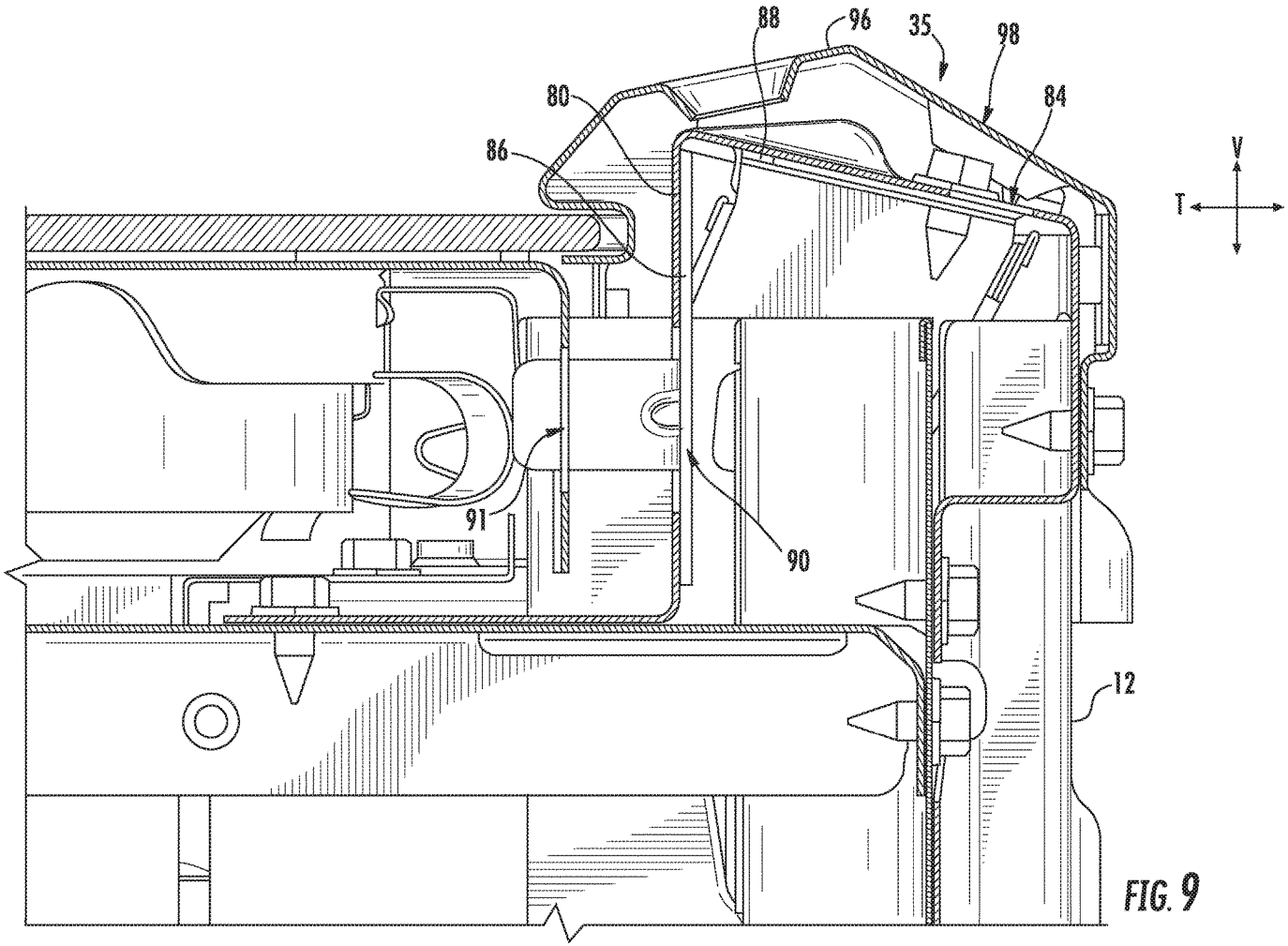
FIG. 9 provides a magnified cross sectional view of a rear portion of the example cooking appliance of FIG. 8.
Figure 10:
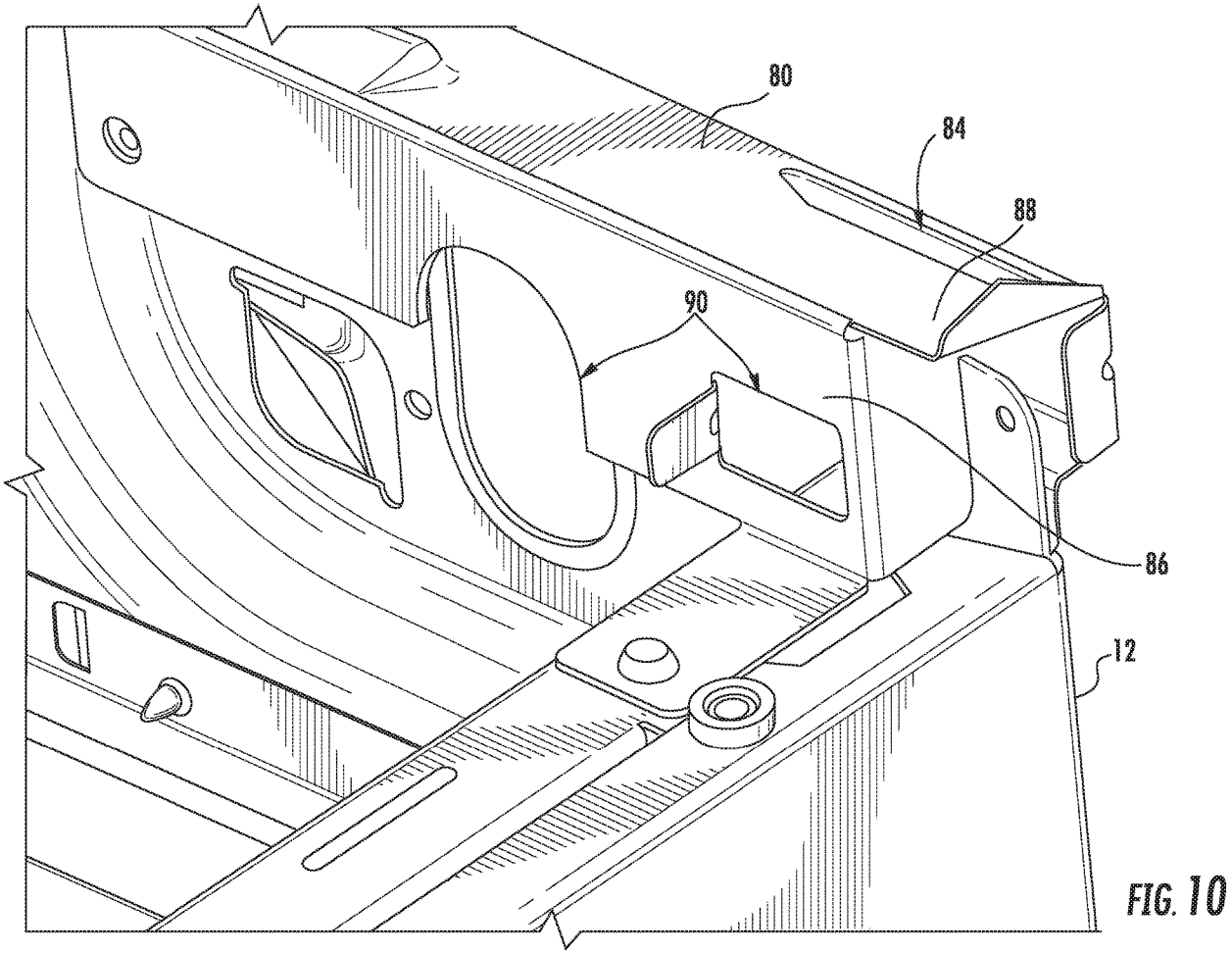
FIG. 10 provides a front perspective view of the rear portion of the example cooking appliance of FIG. 8, wherein a vent trim has been removed.
Figure 11:
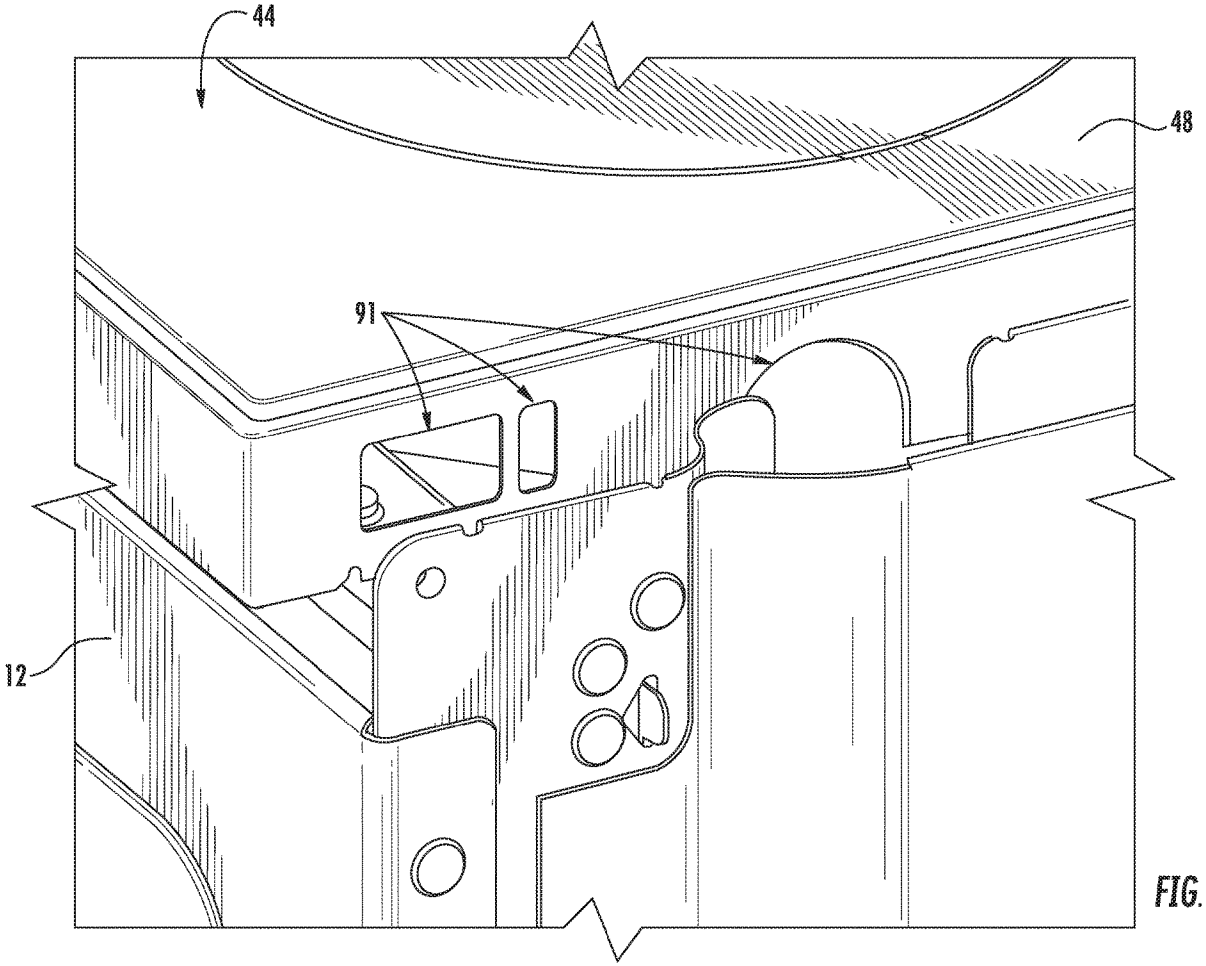
FIG. 11 provides a rear perspective view of the rear portion of the example cooking appliance of FIG. 8, wherein a vent trim and an exhaust panel has been removed.

Turning now to FIGS. 2 and 3, flow of air F enters cooling assembly 50 at the inlet 52 of cooling assembly 50 (e.g., from electronics chamber 58). From the inlet 52, air flows through cooling assembly 50 to outlet 54 of cooling assembly 50. Flow of air F may thus exit cooling assembly 50 at outlet 54 of cooling assembly 50. Generally, flow of air F can assist with limiting heat transfer along the vertical direction V within cooling assembly 50. For example, a lower surface 70 of cooling assembly 50 can be heated during operation of bottom and/or top heating elements 40 and 42 of oven range appliance 10. Flow of air F can be cool relative to lower surface 70 of cooling assembly 50 such that flow of air F limits or reduces heat transfer between lower surface 70 of cooling assembly 50 and an upper surface 72 of cooling assembly 50 (or another portion of appliance 10) during operation of bottom and/or top heating elements 40 and 42. As another example, upper surface 72 of cooling assembly 50 can be heated during operation of heating assemblies 46 of oven range appliance 10. Flow of air F can be cool relative to upper surface 72 of cooling assembly 50 such that flow of air F limits or reduces heat transfer between upper surface 72 of cooling assembly 50 and lower surface 72 of cooling assembly 50 (or another portion of appliance 10) during operation of bottom and/or top heating elements 40 and 42. In such a manner, components of oven range appliance 10, such as electronic or electrical components, above and/or below (or otherwise adjacent to) cooling assembly 50 can be advantageously insulated and/or cooled (e.g., from high temperatures generated at cooking chamber 14 or heating assemblies 46) during operation of oven range appliance 10.

As shown, lower surface 70 of cooling assembly 50 and upper surface 72 of cooling assembly 50 are spaced apart from each other, e.g., along the vertical direction V. Lower surface 70 of cooling assembly 50 and upper surface 72 of cooling assembly 50 maybe substantially parallel to each other from about the front portion 34 of cabinet 12 to about the back portion 35 of cabinet 12. Cooling passage 56 is thus defined between lower surface 70 and upper surface 72.

In some embodiments, oven range appliance 10 also includes features for limiting or reducing heat transfer within door 16, e.g., along the transverse direction T during operation of oven range appliance 10. As may be seen in FIG. 2, door 16 extends between a top lip 65 and a bottom lip 66, e.g., along the vertical direction V when door 16 is in the closed position. Door 16 also defines an inlet 60, a conduit or channel 62, and an exhaust 64. In some embodiments, inlet 60 of door 16 is positioned at or adjacent bottom lip 66 of door 16 and permits air therethrough. Conversely, exhaust 64 of door 16 is positioned at or adjacent top lip 65 of door 16. Channel 62 extends between inlet 60 of door 16 and exhaust 64 of door 16, e.g., such that inlet 60 and exhaust 64 are in fluid communication with each other when door 16 is in the closed position. Channel 62 permits flow of air F to flow through door 16 from inlet 60 to exhaust 64.

Flow of air F through door 16 can assist with limiting or reducing heat transfer along the transverse direction T, e.g., during operation of bottom and/or top heating elements 40 and 42 of oven range appliance 10. As an example, an inner surface 67 of door 16 faces and is positioned adjacent cooking chamber 14 of cabinet 12 when door 16 is in the closed position. Conversely, an outer surface 68 of door 16 is positioned opposite inner surface 67 of door 16 and faces away from cooking chamber 14 of cabinet 12 when door 16 is in the closed position. Inner surface 67 of door 16 can be heated during operation of bottom and/or top heating elements 40 and 42 of oven range appliance 10. Flow of air F can be cool relative to inner surface 67 of door 16 such that flow of air F limits or reduces heat transfer between inner surface 67 of door 16 and outer surface 68 of door 16 during operation of bottom and/or top heating elements 40 and 42 of oven range appliance 10, e.g., such that outer surface 68 of door 16 is cool relative to inner surface 67 of door 16. In such a manner, outer surface 68 of door 16 can be insulated. Optionally, a temperature of outer surface 68 of door 16 may be maintained below a threshold temperature, advantageously preventing or limiting the potential overheating of outer surface 68 of door 16.

As illustrated in FIGS. 3 through 7, inlet 52 of cooling assembly 50 is positioned at or adjacent top lip 65, e.g., such inlet 52 of cooling assembly 50 is configured for receiving flow of air F from exhaust 64 of door 16 during operation of oven range appliance 10.

Electronics chamber 58 generally extends along the lateral direction L between lateral sides of oven range appliance 10. More specifically, electronics chamber 58 may extend between first sidewall 32 and second sidewall 33 of cabinet 12. The electronics chamber 58 may additionally extend along the transverse direction T, e.g., from inlet 52 of cooling assembly 50. The face panel 59 defines one or more ventilation inlets 74 that permit air flow. In some embodiments, each ventilation inlet 74 extends in the vertical direction V to receive air into electronics chamber 58. A back segment of control panel 36 may define one or more apertures 76 that place electronics chamber 58 in fluid communication with cooling passage 56. In this manner, cooling air may flow through electronics chamber 58 to cool electronic components housed therein before being drawn out of electronics chamber 58 through apertures 76. Although apertures 76 are illustrated as one large hole (see FIG. 7), one skilled in the art will appreciate that any aperture having a suitable size and configuration may be used. For example, according to an alternative embodiment, a large number of small holes, or another suitable arrangement that places electronics chamber 58 in fluid communication with cooling passage 56 may be used.

In some embodiments, one or more cooling conduits 78 are provided within electronics chamber 58. As shown, each cooling conduit 78 may extend along the transverse direction T through the electronics chamber 58, thereby guiding air flow (e.g., flow of air F). Specifically, cooling conduit 78 may extend from the ventilation inlet 74 to the apertures 76 and/or cooling passage 56. The cooling conduit or conduit 78 may direct and/or isolate air passing through electronics chamber 58 to cooling passage 56. In some such embodiments, each cooling conduit 78 corresponds to a discrete ventilation inlet 74. If multiple cooling conduits 78 are included, each cooling conduit 78 may be spaced apart, e.g., along the lateral direction L. Optionally, a first cooling conduit 78 may be positioned proximate to first sidewall 32, while a second cooling conduit 78 is positioned proximate to second sidewall 33.

When assembled, door 16 and cabinet 12 define one or more air channels or gaps G1, G2, G3 therebetween. For instance, a first air gap G1 may be defined between face panel 59 and door 16. In some such embodiments, face panel 59 is directed towards first air gap G1 (e.g., such that a planar surface of face panel 59 faces first air gap G1). In turn, first air gap G1 is defined in the vertical direction V from top lip 65 toward face panel 59. Ventilation inlet 74 and exhaust 64 of door 16 are positioned at or adjacent first air gap G1. Thus, ventilation inlet 74 of cooling assembly 50 and exhaust 64 of door 16 are aligned and spaced apart from each other along the vertical direction V by first air gap G1. In further embodiments, a second air gap G2 is defined in the transverse direction T between cabinet 12 and door 16, specifically top lip 65. As shown, second air gap G2 may be in fluid communication with first air gap G1 such that air may generally pass freely therebetween. Additionally or alternatively, one or more third air gaps G3 may be defined in the lateral direction L between a sidewall 32 or 33 of cabinet 12 and a side portion of door 16. Each third air gap G3 may be in fluid communication with first air gap G1 and/or second air gap G2 such that air may generally pass freely therebetween.

In certain embodiments, gasket 20 is positioned at one or more air gap, e.g., second air gap G2. When assembled, gasket 20 generally extends across one or more of the gaps G1, G2, G3 between door 16 and cabinet 12, e.g., when door 16 is in the closed position. Inlet 52 of cooling assembly 50 and exhaust 64 of door 16 are positioned above gasket 20, e.g., along the vertical direction V, when door 16 is in the closed position.

During operation of oven range appliance 10, flow of air F enters channel 62 of door 16 at inlet 60 of door 16 and flows through channel 62 of door 16 to exhaust 64 of door 16. Within door 16, flow of air F advantageously limits or hinders heat transfer along the transverse direction T, e.g., in the manner discussed above. Flow of air F exits channel 62 of door 16 at exhaust 64 of door 16 and enters air gaps G1, G2. Within air gaps G1, G2, flow of air F can mix with air previously present in air gaps G1, G2. Moreover, air may be further drawn from air gap G3. From air gaps G1, G2, G3, flow of air F enters cooling assembly 50 at inlet 52 of cooling assembly 50. Flow of air F passes through cooling assembly 50 and advantageously limits or hinders heat transfer along the vertical direction V, e.g., below the electronics within electronics chamber 58.

In some embodiments, an air handler 92 is mounted in fluid communication with output vent(s) 84 and cooling passage 56, generally. For instance, air handler 92 may be a fan placed within cooling passage 56 and configured for drawing air from inlet 52 and electronics chamber 58 and discharging air from outlet 54. According to the illustrated embodiment of FIG. 3, air handler 92 is a tangential fan that is positioned toward a back end of cooling passage 56 proximate to back portion 35 of cabinet 12. However, one skilled in the art will appreciate that any other suitable fan type, position, or configuration may be used while remaining within the scope of the present disclosure. For example, air handler 92 could instead be a radial fan positioned toward a front end of cooling passage 56. Alternatively, no air handler may be included, such that air flow is promoted through natural convection.

Turning now to FIGS. 8 through 11, an example cooking appliance 10 is provided. It is understood that, except as otherwise indicated, the embodiment of FIGS. 8 through 11 is similar to the embodiment of FIG. 1. For instance, the example of embodiment of FIGS. 8 through 11 lacks an air handler, such that air is motivated by natural convection. Nonetheless, it is noted that an air handler may be provided in alternative examples.

As shown, an exhaust panel 80 is positioned at back portion 35 of cabinet 12. Specifically, exhaust panel 80 extends along at least a segment of the top portion 30 of cabinet 12 (e.g., along the lateral direction L and thereabove (e.g., along the vertical direction V such that exhaust panel is higher relative to the vertical direction V). When assembled, exhaust panel 80 defines a portion of outlet 54, e.g., as one or more output vents 84. In turn, exhaust panel 80 may direct a portion of flow of air F (FIG. 3).

Each output vent 84 may extend along the vertical direction V. Multiple output vents 84 may be laterally spaced. In some embodiments, at least one output vent 84 is defined proximate to each of the opposing sidewalls 32, 33. A first output vent 84 is defined proximate to first sidewall 32, and a second output vent 84 is defined proximate to second sidewall 33. Optionally, exhaust panel 80 may be a contoured (e.g., non-planar) member. Exhaust panel 80 may further include a vertical segment 86 and an angled segment 88, e.g., bent to at least partially enclose a portion of cabinet 12. In some such embodiments, a primer vent 90, 91 is defined upstream from the output vent 84. For instance, a primer vent 90 may be defined in the vertical segment 86 of exhaust panel 80. In turn, output vent 84 may be defined in the angled segment 88. Additionally or alternatively, a primer vent 91 may be defined beneath top panel 48 upstream from output vent 84. Optionally, one primer vent 91 may be upstream from another primer vent 90, and laterally aligned thereto. In turn, air may flow from cooling passage 56, through primer vent(s) 91 and/or 90, and from output vent 84 as the air exits exhaust panel 80. Generally, at least one primer vent 90 and/or 91 may be aligned (e.g., laterally) with at least one output vent 84 to direct air thereto. Advantageously, exhaust panel 80 may promote airflow at the lateral extremes of the cabinet 12 and cooling passage 56, preventing or limiting air stagnation therein.

In certain embodiments, a vent trim 96 extends over (e.g., above relative to the vertical direction V) exhaust panel 80 along the lateral direction L. Specifically, vent trim 96 may cover at least a portion of exhaust panel 80 at the back portion 35 of cabinet 12. Vent trim 96 may be in fluid communication with outlet 54 and define one or more vertical trim openings 98 thereabove. Specifically, a discrete vertical trim opening 98 may be defined proximate to each of the opposing sidewalls 32, 33. One vertical trim opening 98 may be laterally aligned with a first output vent 84 proximate to first sidewall 32, while another vertical trim opening 98 is laterally aligned with a second output vent 84 proximate to second sidewall 33. Air may thus flow from exhaust outlet 54 and out of appliance 10 through vertical trim openings 98.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance defining a vertical direction, a lateral direction, and a transverse direction, the cooking appliance comprising:

a cabinet extending in the vertical direction between a top portion and a bottom portion, in the lateral direction between opposing sidewalls, the cabinet defining a cooling passage extending along the top portion;

a control panel mounted to the cabinet in fluid communication with the cooling passage, the control panel defining a portion of an electronics chamber;

a face panel extending below the top portion of the cabinet relative to the vertical direction at a front portion of the cabinet, the face panel defining a ventilation inlet in fluid communication with the cooling passage to direct air through the electronics chamber; and at least one cooling conduit extending along the transverse direction through the electronics chamber from the ventilation inlet to the cooling passage, the cooling conduit defining an isolated airflow path isolating air passing through the electronics chamber to cooling passage.

2. The cooking appliance of claim 1, further comprising a cooktop extending above the cooling passage, and a heating element attached to the cooktop.

3. The cooking appliance of claim 1, wherein the cabinet defines a cooking chamber below the cooling passage.

4. The cooking appliance of claim 3, further comprising a door mounted on the cabinet below the cooling passage to selectively restrict access to the cooking chamber in a closed setting.

5. The cooking appliance of claim 4, wherein the door extends along the vertical direction from a bottom lip to a top lip, wherein the door defines a door exhaust in fluid communication with the cooling passage at the top lip of the door in the closed setting.

6. The cooking appliance of claim 5, wherein the door defines a door inlet at the bottom lip to permit air therethrough.

7. The cooking appliance of claim 5, wherein the oven appliance defines a first air gap between the face panel and the door along the vertical direction in the closed setting.

8. The cooking appliance of claim 7, wherein the oven appliance defines a second air gap between the cabinet and the door in the closed setting, the second air gap being in fluid communication with the first air gap.

9. The cooking appliance of claim 7, wherein the face panel is directed toward the first air gap, and wherein the ventilation inlet extends along the vertical direction.

10. The cooking appliance of claim 1, wherein the at least one cooling conduit includes a first and second cooling conduit spaced apart along the lateral direction, and wherein each of the first and second cooling conduit is positioned proximate to one of the opposing sidewalls.

11. The cooking appliance of claim 1, further comprising an air handler mounted in fluid communication with the cooling passage to motivate air therethrough.

12. The cooking appliance of claim 1, further comprising an exhaust panel positioned at the rear portion of the cabinet, the exhaust panel defining an output vent in fluid communication with the cooling passage to permit air therefrom.

13. A cooking appliance defining a vertical direction, a lateral direction, and a transverse direction, the cooking appliance comprising:

a cabinet extending in the transverse direction between a rear portion and a front portion, in the lateral direction between opposing sidewalls;

a top panel extending along a top portion of the cabinet;

a heating element attached to the top panel;

an internal wall extending below the top panel such that a cooling passage is defined between the top panel and the internal wall;

an exhaust panel positioned at the rear portion of the cabinet, the exhaust panel defining an output vent proximate to one of the opposing sidewalls in fluid communication with the cooling passage;

a control panel mounted to the cabinet in fluid communication with the cooling passage, the control panel defining a portion of an electronics chamber;

a face panel extending below the top portion of the cabinet relative to the vertical direction, the face panel defining a ventilation inlet in fluid communication with the cooling passage to direct air through the electronics chamber; and at least one cooling conduit extending along the transverse direction through the electronics chamber from the ventilation inlet to the cooling passage, the cooling conduit defining an isolated airflow path isolating air passing through the electronics chamber to cooling passage.

14. The cooking appliance of claim 13, further comprising a vent trim extending over the exhaust panel along the lateral direction at the rear portion of the cabinet, the vent trim being in fluid communication with the exhaust outlet and defining a vertical trim opening to permit air therefrom.

15. The cooking appliance of claim 13, wherein the output vent is a first output vent, wherein the exhaust panel further defines a second output vent spaced apart from the first output vent along the lateral direction proximate to the other of the opposing sidewalls.

16. The cooking appliance of claim 13, further comprising an air handler mounted in fluid communication with the cooling passage to motivate air therethrough.

17. The cooking appliance of claim 13, wherein the cabinet defines a cooking chamber below the internal wall.

18. The cooking appliance of claim 17, further comprising a door mounted on the cabinet below the cooling passage to selectively restrict access to the cooking chamber in a closed setting, wherein the door extends along the vertical direction from a bottom lip to a top lip, wherein the door defines a door exhaust in fluid communication with the cooling passage at the top lip of the door in the closed setting.

19. The cooking appliance of claim 13, further comprising a primer vent upstream from outlet vent and proximate to the one of the opposing sidewalls.

* * * * *